US006884125B2

(12) United States Patent
Chen

(10) Patent No.: US 6,884,125 B2
(45) Date of Patent: Apr. 26, 2005

(54) SECURED CONNECTOR AND USING PROCESS THEREOF

(75) Inventor: Chun-Chen Chen, Jungli (TW)

(73) Assignee: Delta Electronic, Inc., Jungli (TW)

( * ) Notice: Subject to any disclaimer, the term of this patent is extended or adjusted under 35 U.S.C. 154(b) by 101 days.

(21) Appl. No.: 10/425,225

(22) Filed: Apr. 29, 2003

(65) Prior Publication Data

US 2003/0203682 A1 Oct. 30, 2003

(30) Foreign Application Priority Data

Apr. 30, 2002 (TW) ..... 91109041 A

(51) Int. Cl.[7] ..... H01R 11/22; H01R 13/11

(52) U.S. Cl. ..... 439/848; 439/650; 439/173

(58) Field of Search ..... 439/650, 651, 439/653, 172, 173, 174, 848, 849, 333, 337, 673, 674, 102, 655

(56) References Cited

U.S. PATENT DOCUMENTS 2,459,032 A * 1/1949 Korth ..... 439/29
2,802,192 A * 8/1957 Johnson ..... 439/651
4,579,410 A * 4/1986 Soloman ..... 439/133
4,787,857 A * 11/1988 Kretchmar et al. ..... 439/189
4,973,827 A * 11/1990 Nozaki ..... 219/521
5,451,173 A * 9/1995 Mai ..... 439/622
5,613,863 A 3/1997 Klaus et al.
6,039,608 A * 3/2000 Amero et al. ..... 439/651
6,059,584 A * 5/2000 Mareno ..... 439/131
6,371,815 B1 * 4/2002 Wetzel et al. ..... 439/651

* cited by examiner

*Primary Examiner*—Hae Moon Hyeon
(74) *Attorney, Agent, or Firm*—Volpe And Koenig, P.C.

(57) ABSTRACT

The present invention discloses a secured connector and a using process thereof. The secured connector includes a connector body with one end having at least a conductive terminal for plugging in a socket, a cover located at another end of the connector body and having at least an arc opening for a plug of an electronic apparatus to plug therethrough, and a securing device located in an interior of the connector body and including at least a conductive spring piece forming at least an arc trench for directing the plug to a securing position, so that the plug is secured with a securing knob on the conductive spring piece.

9 Claims, 8 Drawing Sheets

SECURED CONNECTOR AND USING PROCESS THEREOF

FIELD OF THE INVENTION

This invention relates to a connector, and more particularly to a secured connector and a using process thereof.

BACKGROUND OF THE INVENTION

With the progressing of science and technology, a variety of electric appliances become essential tools in life. The power converter, which is frequently used in the daily life, is used to rectify the commercially available AC power and convert it into the DC power for providing the desired power to the electric appliance.

The power converter, such as an adapter and a charger, includes a plug for plugging in a socket and receiving the commercially available AC power. Since there are various kinds of socket standards, the power converter is usually connected to a connector having different forms of conductive terminals to correspond to the different socket standards.

While using the connector, however, if the connector cannot be effectively secured with the power converter, the connector may be remained on the socket when pulling out the power converter, which may cause a danger of electric shock. In addition, the power converter may be loosened and dissembled from the connector, which may cause power failure of the electric appliance or data loss.

For effectively securing the connector with the power converter, the conventional connector and power converter usually have corresponding structures respectively for fitting with each other (as disclosed in U.S. Pat. No. 5,613,863). However, such way is inconvenient to the user since different power converters must be used with different connectors so as to be effectively secured.

To overcome the disadvantages of the prior art described above, the present invention provides a secured connector designed for the American standard plug, which can be effectively secured with the power converter without using any specific structure on the power converter.

SUMMARY OF THE INVENTION

It is an object of the present invention to provide a secured connector for effectively securing with a power converter.

It is another object of the present invention to provide a secured connector for applying to any power converter having the American standard plug.

In accordance with an aspect of the present invention, the secured connector includes a connector body with one end having at least a conductive terminal for plugging in a socket, a cover located at another end of the connector body and having at least an arc opening for a plug of an electronic apparatus to plug therethrough, and a securing device located in an interior of the connector body and including at least a conductive spring piece forming at least an arc trench for directing the plug to a securing position, so that the plug is secured with a securing knob on the conductive spring piece.

Preferably, the electronic apparatus is one selected from a group consisting of an adapter, a charger and an AC power cord.

Preferably, the plug includes at least a conductive prong for electrically connecting with the connector.

Preferably, the conductive prong has a hole for securing with the securing knob.

Preferably, the securing knob has a top located at the opposite side to a plugging side of the plug.

Preferably, the arc opening is corresponding to the arc trench.

Preferably, the conductive spring piece further includes a positioning knob for positioning the plug at a first position.

Preferably, the securing knob has a bigger thickness than the positioning knob does.

Preferably, the plug is rotated between the first position and the securing position along the arc trench.

In accordance with another aspect of the present invention, the process for using a secured connector includes steps of plugging a plug of an electronic apparatus at a first position of the connector through at least an arc opening of the connector, rotating the plug from the first position to a second position along the arc opening for securing the plug with the connector, and connecting the connector with a socket for providing power to the electronic apparatus.

The process further includes steps of pulling the connector out of the socket, rotating the plug from the second position to the first position, and pulling the plug out of the connector.

Preferably, the connector includes a securing device, which includes at least a conductive spring piece for forming at least an arc trench corresponding to the arc opening.

Preferably, the conductive spring piece includes a positioning knob for positioning the plug at the first position, and a securing knob for securing the plug at the second position.

Preferably, the securing knob has a bigger thickness than the positioning knob does, and has a top located at the opposite side to a plugging side of the plug.

Preferably, the plug is rotated between the first position and the second position along the arc trench.

In accordance with another aspect of the present invention, the process for using a secured connector includes steps of plugging a plug of an electronic apparatus at a securing position of the connector for securing the plug with the connector, connecting the connector with a socket for providing power to the electronic apparatus, pulling the connector out of the socket, rotating the plug from the securing position to a positioning position, and pulling the plug out of the connector.

The process further includes steps of plugging the plug of the electronic apparatus at the positioning position of the connector through at least an arc opening of the connector, and rotating the plug from the positioning position to the securing position along the arc opening.

Preferably, the connector includes a securing device, which includes at least a conductive spring piece for forming at least an arc trench corresponding to said arc opening.

Preferably, the conductive spring piece includes a positioning knob for positioning the plug at the positioning position, and a securing knob for securing the plug at the securing position.

Preferably, the securing knob has a bigger thickness than the positioning knob does, and has a top located at the opposite side to a plugging side of the plug.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1A:
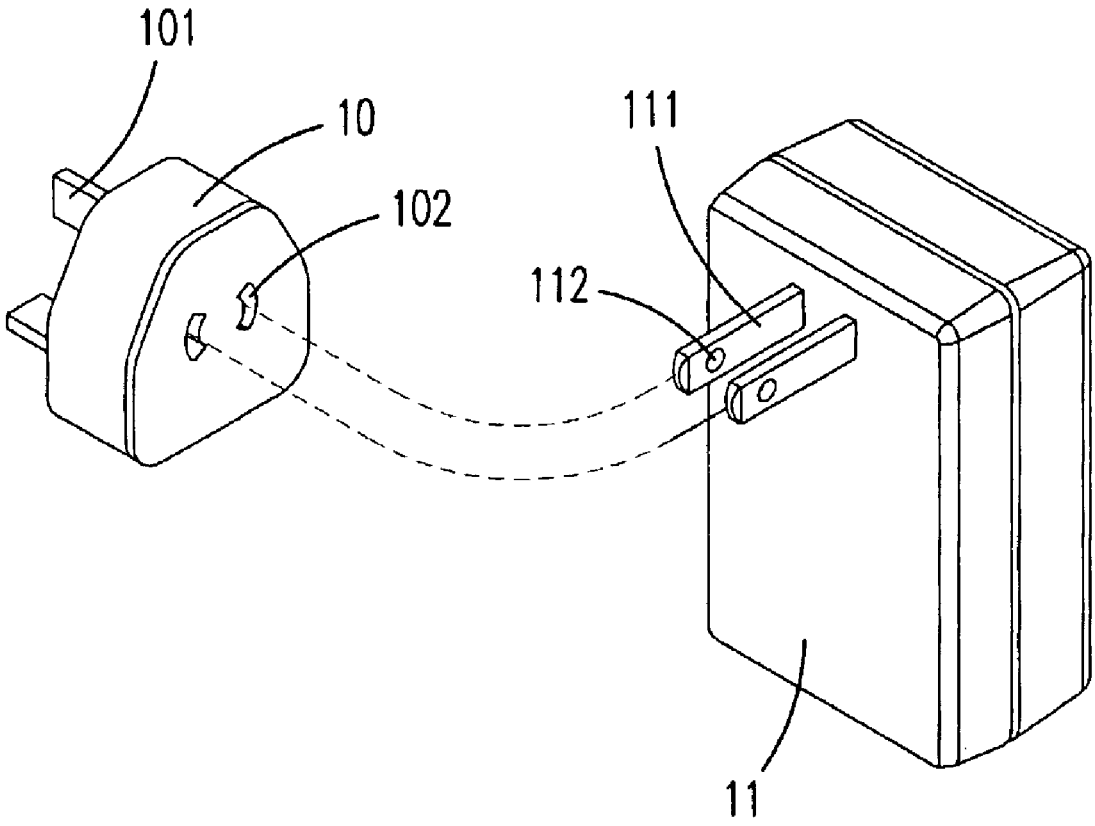
FIGS. 1(*a*) to 1(*b*) are schematic views showing the assembly structure of the connector and the power converter according to preferred embodiments of the present invention.
Figure 1B:
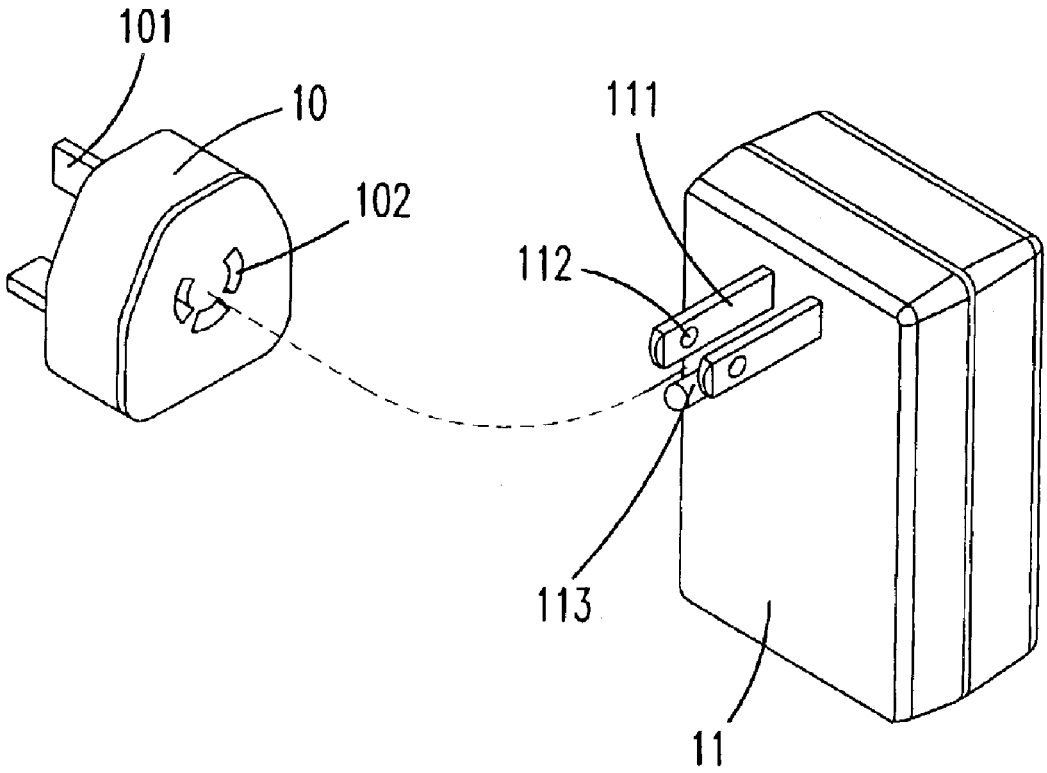
Figure 2:
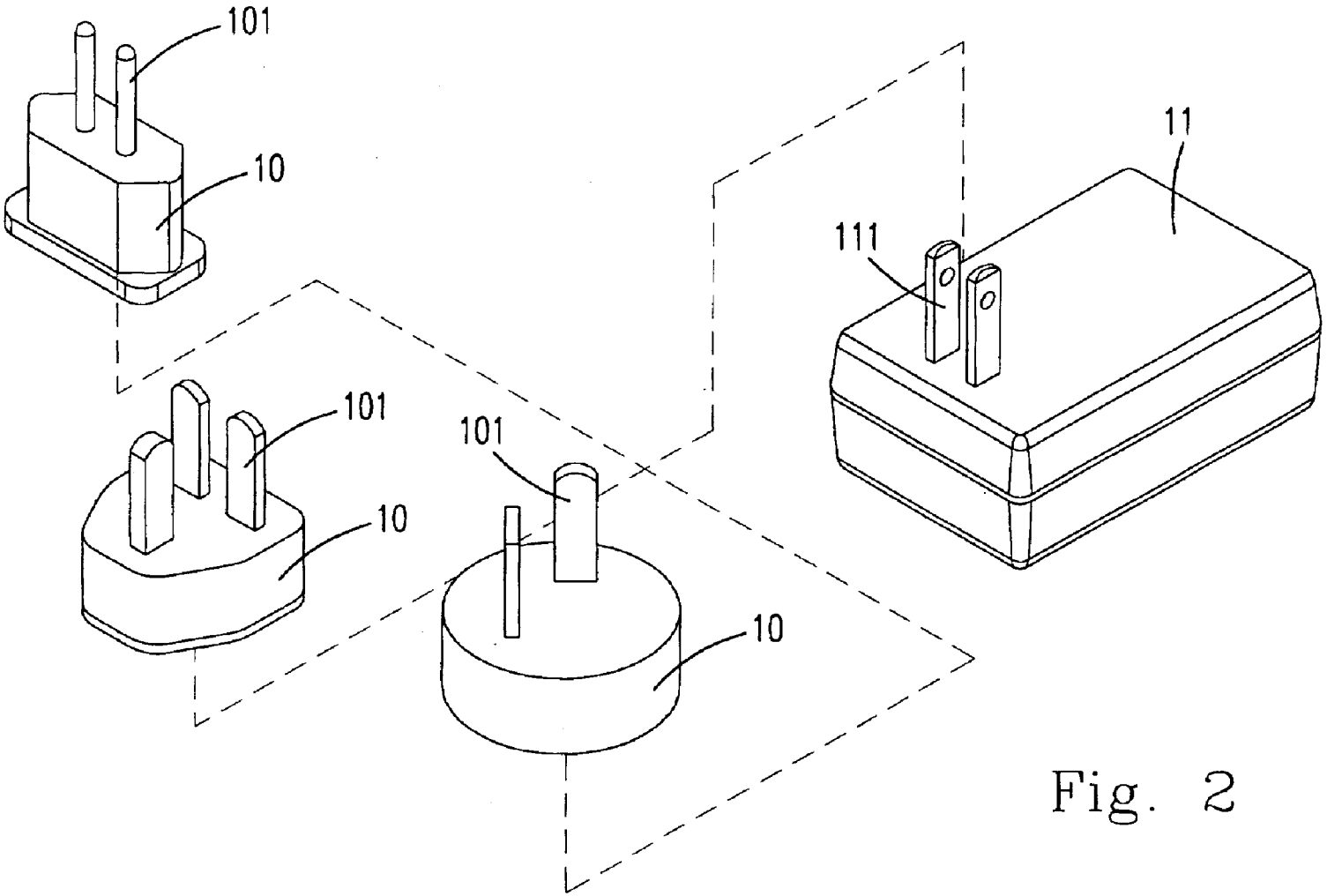
FIG. 2 shows a variety connectors having different forms of the conductive terminals.

Please refer to FIGS. 1(*a*) to 1(*b*) which are schematic views showing the assembly structure of the connector 10 and the power converter 11 according to preferred embodiments of the present invention. The plug of the power converter 11 (such as an adapter and a charger), which conforms to the American standard, includes two parallel conductive prongs 111 having two holes 112 at the front ends thereof, respectively. The conductive prongs 111 are plugged into the connector 10 through two arc openings 102 of the connector 10 (as shown in FIG. 1(*a*)). Of course, the plug can also includes two conductive prongs 111 and a conductive stick 113, and are plugged into the connector 10 through three arc openings 102 of the connector 10 (as shown in FIG. 1(*b*)). In addition, the shapes and the number of the conductive terminals 101 of the connector 10 can be varied, as shown in FIG. 2, depending on the standards of the corresponding sockets.

Figure 3:
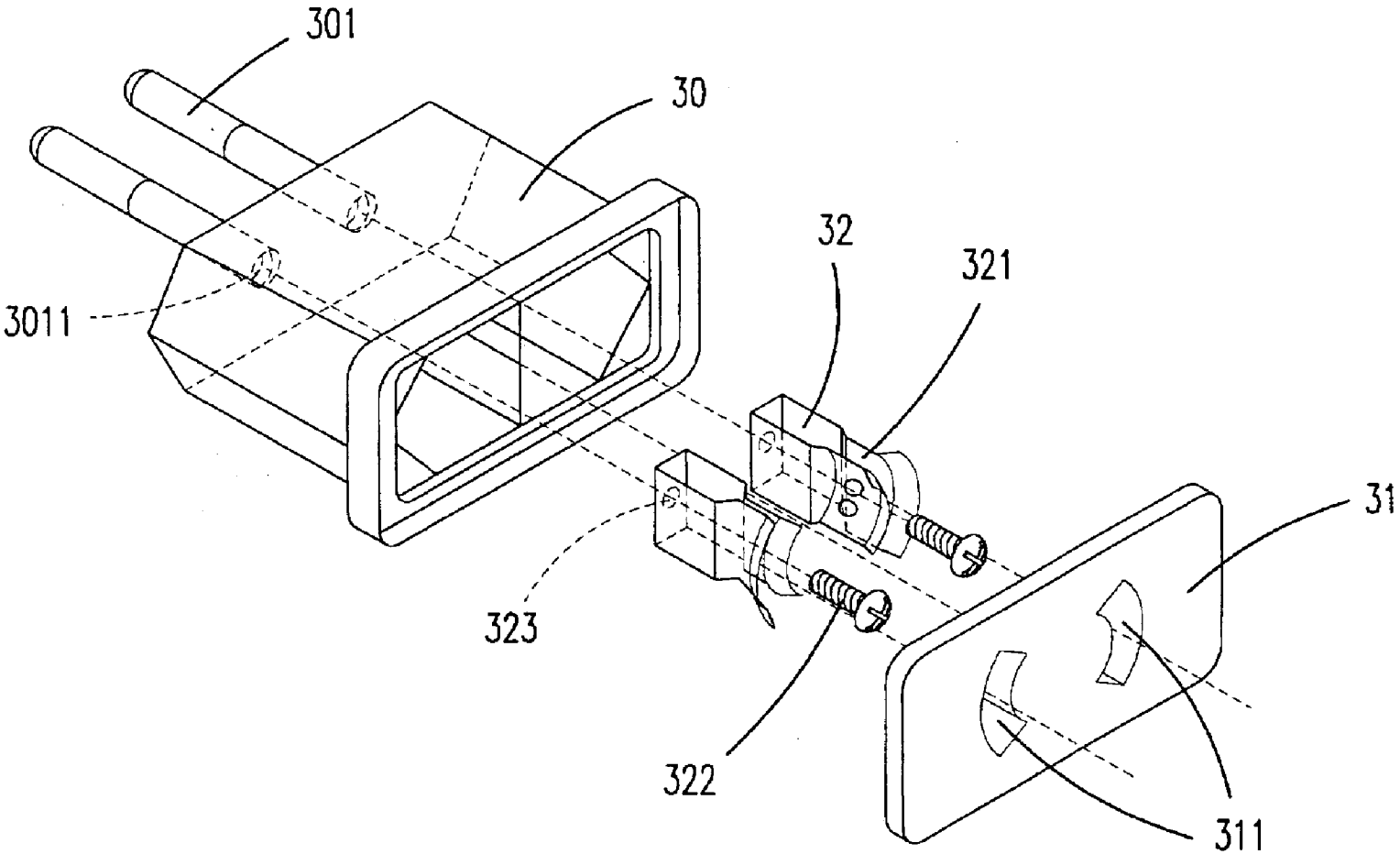
FIG. 3 is a schematic view showing the structure of the connector according to a preferred embodiment of the present invention.

Please refer to FIG. 3 which is a schematic view showing the structure of the connector according to a preferred embodiment of the present invention. The connector includes a connector body 30, a cover 31 and a securing device 32. The connector body 30 has two conductive terminals 301 located at one end thereof for plugging in a socket (not shown). The cover 31 is located at another end of the connector body 31 and having two arc openings 311 for the conductive prongs of the power converter to plug therethrough. The securing device 32 is located in the interior of the connector body 30, and includes two conductive spring pieces forming respectively two arc trenches 321, which are corresponding to the arc openings 311. The securing device 32 can be fixed to the connector body 30 by a screw, which passes through a screw hole 323 at the bottom of the securing device 32, and is fixed in the thread 3011 at the end of the conductive terminal 301, so as to be electrically connected. In addition, the securing device 32 can also be fixed and electrically connected to the conductive terminal 301 by riveting or welding.

Figure 4A:
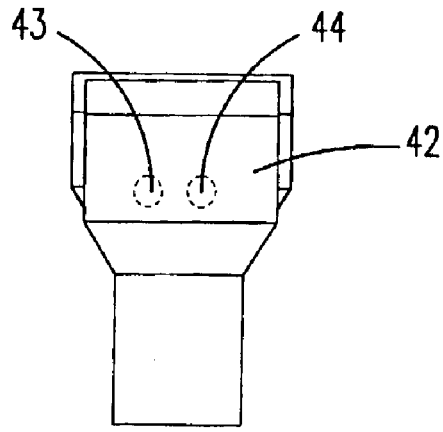
FIGS. 4(*a*) to 4(*c*) are the front, top and side views showing the structure of the securing device according to the preferred embodiment of the present invention.
Figure 4B:
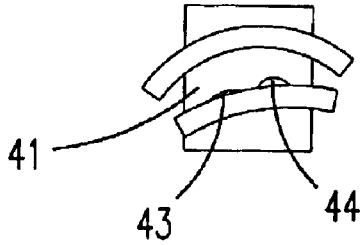
Figure 4C:
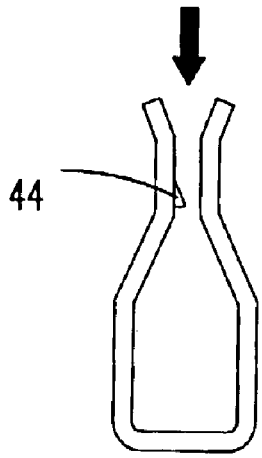

Please refer to FIGS. 4(*a*) to 4(*c*) which are the front, top and side views showing the structure of the securing device according to the preferred embodiment of the present invention. The conductive spring piece 42, which forms the arc trench 41, has a positioning knob 43 and a securing knob 44 on one side thereof. The securing knob 44 has a bigger thickness than the positioning knob 43 does (as shown in FIG. 4(*b*)), and the securing knob 44 has a top located at the opposite side to a plugging side of the plug (as shown in FIG. 4(*c*), the arrow indicates the plugging direction of the plug).

Figure 5A:
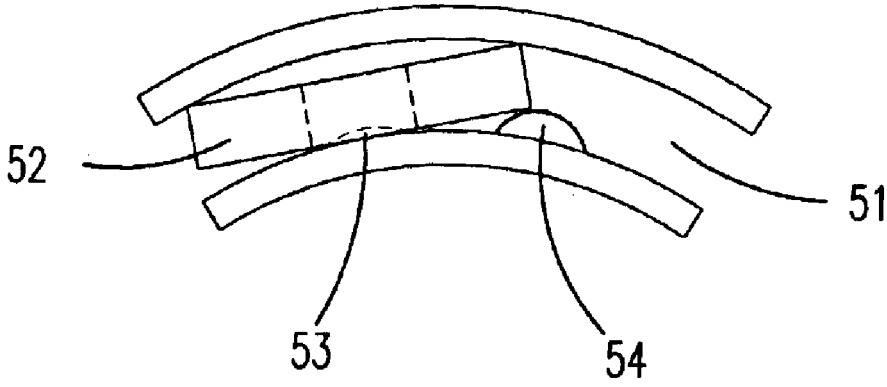
FIGS. 5(*a*) to 5(*b*) are schematic views showing the relative positions of the plug and the securing device according to the preferred embodiment of the present invention.
Figure 5B:
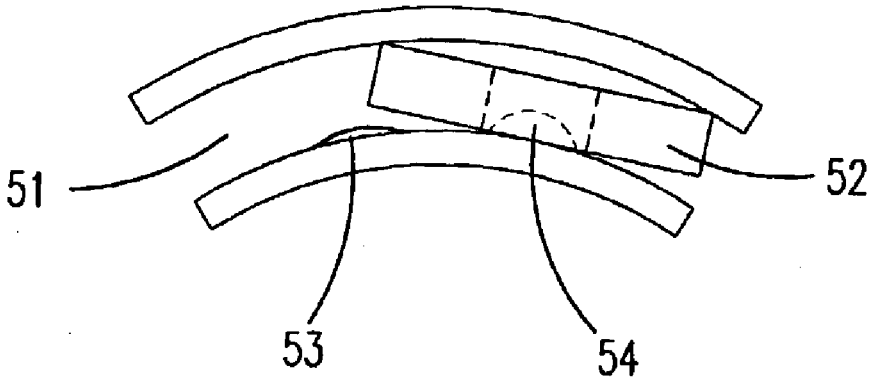

Please refer to FIGS. 5(*a*) to 5(*b*) which are schematic views showing the relative positions of the plug and the securing device according to the preferred embodiment of the present invention. When the plug of the power converter is plugged in the arc trench 51 formed by the securing device of the connector, the conductive prong 52 of the plug first contacts with the positioning knob 53 at a first position or named positioning position (as shown in FIG. 5(*a*)). The positioning knob 53 can fit with the hole at the front end of the conductive prong 52 for positioning the conductive prong 52 at the first position. It is easy to pull the conductive prong 52 out of the connector when the conductive prong 52 is located at the first position, since the positioning knob 53 has a small thickness and cannot secure the conductive prong 52 completely. Along the arc trench 51, the conductive prong 52 can be rotated from the first position to a second position or named securing position to contact with the securing knob 54 (as shown in FIG. 5(*b*)). The securing knob 54 can also fit with the hole at the front end of the conductive prong 52. Since the securing knob 54 has a bigger thickness and its top is located at the opposite side to a plugging side of the conductive prong 52, it can secure the conductive prong 52 completely. Therefore, when the conductive prong 52 is located at the second position, it cannot be pulled out of the connector.

Figure 6A:
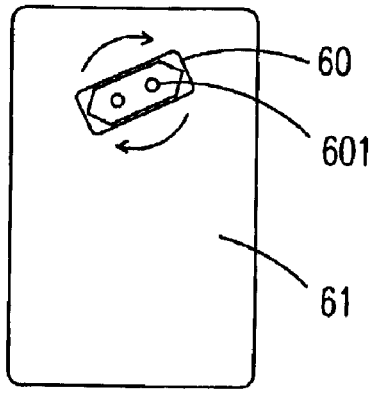
FIGS. 6(*a*) to 6(*c*) are schematic views showing the process for using the connector according to the preferred embodiment of the present invention.
Figure 6B:
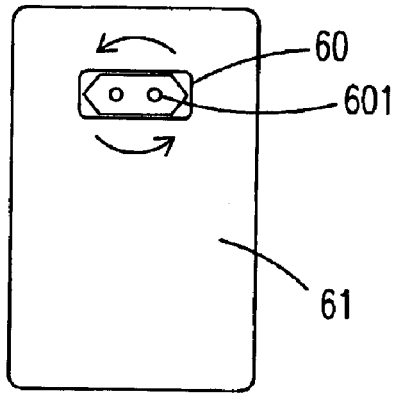
Figure 6C:
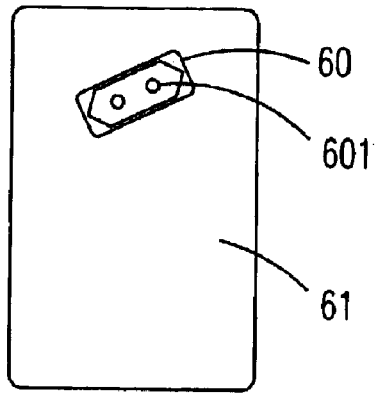

Please refer to FIGS. 6(*a*) to 6(*c*). The present invention also provides a process for using the connector as described above, which includes the following steps. First, the plug of the power converter 61 is plugged in and at the first position of the connector 60 through the arc openings for positioning. At this time, the connector 60 is assembled on the power converter 61 with an angle (as shown in FIG. 6(*a*)), and is not completely secured with the power converter 61, so that the plug of the power converter 61 can be easily pulled out of the connector 60. Then the plug is rotated along the arc openings to the second position, and at this time, the connector 60 is assembled on the power converter 61 regularly (as shown in FIG. 6(*b*)). Since the plug of the power converter 61 can be secured completely by said securing knob, it cannot be pulled out of the connector 60. Finally, the conductive terminals 601 of the connector 60 are plugged in the socket for providing power to the power converter 61, which can be used safely. When the power converter 61 is not used, the conductive terminals 601 are pulled out of the socket, and then the plug of the power converter 61 is rotated from the second position to the first position (as shown in FIG. 6(*c*)), and finally, the plug of the power converter 61 is pulled out of the connector 60.

Figure 7:
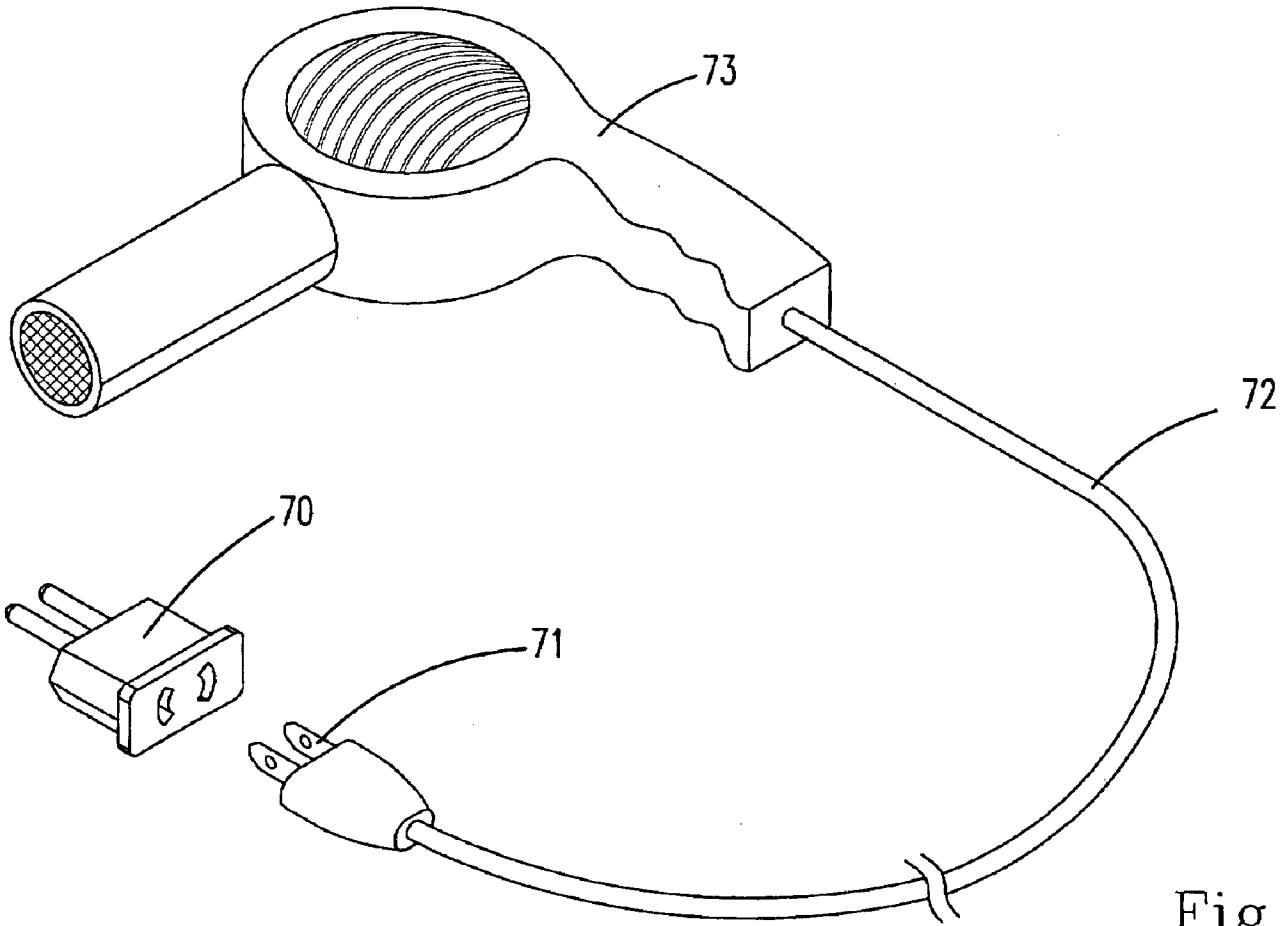
FIG. 7 is a schematic view showing the assembly structure of the connector and the electric appliance having an AC power cord according to another preferred embodiment of the present invention.

Please refer to FIG. 7. Since the connector 70 of the present invention is designed for the plug which conforms to the American standard, it can be also secured with the plug 71 of an AC power cord 72 of an electric appliance (such as a hair dryer 73).

In conclusion, the present invention provides a secured connector designed for the American standard plug of a power converter (such as an adapter and a charger). The secured connector has a securing device therein for effectively securing and safely pulling out. In addition, the use of the securing device does not need a corresponding structure on the power converter, so the connector of the present invention can be applied to any power converter having an American standard plug, and also to any electric appliance having an AC power cord with an American standard plug. Furthermore, except the size, the Japanese standard plug is the same as the American standard plug, so the secured connector of the present invention can be also applied to any power converter having a Japanese standard plug, and any electric appliance having an AC power cord with a Japanese standard plug.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A securing connector, comprising:

a connector body with one end having at least a conductive terminal for plugging in a socket;

a cover located at another end of said connector body and having at least an arc opening for a plug of an electronic apparatus to plug therethrough; and a securing device located in an interior of said connector body and comprising at least a conductive spring piece forming at least an arc trench for directing said plug to a securing position, so that said plug is secured with a securing knob on said conductive spring piece, wherein said plug comprises at least a conductive prong for electrically connecting with said connector and said conductive prong has a hole for securing therein said securing knob.

2. The secured connector according to claim 1 wherein said electronic apparatus is one selected from a group consisting of an adapter, a charger and an AC power cord.

3. The secured connector according to claim 1 wherein said securing knob has a top located at the opposite side to a plugging side of said plug.

4. The secured connector according to claim 1 wherein said arc opening is corresponding to said are trench.

5. The secured connector according to claim 1 wherein said conductive spring piece further comprises a positioning knob for positioning said plug at a first position.

6. The secured connector according to claim 5 wherein said securing knob has a bigger thickness than said positioning knob does.

7. The secured connector according to claim 5 wherein said plug is rotated between said first position and said securing position along said arc trench.

8. An electrical connector comprising:

an insulating housing having first and second openings on opposite ends thereof, the first opening having at least one conductive prong extending therefrom, and the second openings defining at least two holes for receiving the conductive prongs of a plug, the at least two holes being accurately shaped larger than the prongs;

a securing device located within the housing and defining at least two trenches that align with the second openings and at least two holes, the trenches comprising on an interior surface thereof, a positioning knob and a securing knob, the securing knob being larger than the positioning knob.

9. The electrical connector of claim 8 wherein the positioning knob is configured to allow for engagement of the prongs upon insertion of the prongs into the trench, and the securing knob is configured to, upon rotation of the prongs within the holes, secure the prong against removal of the prongs from the holes.

* * * * *